US011676486B2

(12) United States Patent
Marsh et al.

(10) Patent No.: US 11,676,486 B2
(45) Date of Patent: Jun. 13, 2023

(54) RAPID DEPLOYMENT OPERATOR CONTROLLED PORTABLE EMERGENCY TRAFFIC CONTROL SYSTEM

(71) Applicants: Steven William Marsh, Hunlock Creek, PA (US); Jordan Joseph Marsh, Duryea, PA (US)

(72) Inventors: Steven William Marsh, Hunlock Creek, PA (US); Jordan Joseph Marsh, Duryea, PA (US)

( * ) Notice: Subject to any disclaimer, the term of this patent is extended or adjusted under 35 U.S.C. 154(b) by 0 days.

(21) Appl. No.: 17/083,257

(22) Filed: Mar. 8, 2021

(65) Prior Publication Data

US 2022/0406177 A1 Dec. 22, 2022

(51) Int. Cl.
*G08G 1/0955* (2006.01)
*G08G 1/07* (2006.01)

(52) U.S. Cl.
CPC ..... *G08G 1/0955* (2013.01); *G08G 1/07* (2013.01)

(58) Field of Classification Search
CPC ..... G08G 1/0955; G08G 1/07
See application file for complete search history.

(56) References Cited

U.S. PATENT DOCUMENTS 8,164,483 B1 * 4/2012 Phillips ..... E01F 9/681 116/63 P
8,319,662 B1 * 11/2012 Bontemps ..... G08G 1/0955 340/908
2012/0262304 A1 * 10/2012 Cripps ..... G08G 1/0955 340/908
2015/0054660 A1 * 2/2015 Simmons ..... G09F 9/30 340/908
2018/0142436 A1 * 5/2018 Agajanian ..... E01F 9/30

* cited by examiner

*Primary Examiner* — Sisay Yacob

(57) ABSTRACT

A user-controlled portable traffic control system comprises one or more traffic signal units and a wireless handheld remote-control unit. Each traffic signal unit provides instruction to approaching motorists via a segmented backlit display consisting of first and second message panels. The wireless handheld remote-control unit allows a user to communicate commands to the traffic signal units via a transceiver circuit. Additionally, the handheld remote-control unit includes an interface indicating system status information via a plurality of indicator lights corresponding to the traffic signal units.

Each traffic signal unit is housed in a two-part collapsible rigid outer case with a mounting handle allowing for ease of transport and a versatile means of both mounting and transporting the system.

5 Claims, 10 Drawing Sheets

FIG. 10 depicts a front perspective view of a static message panel.

FIG. 11 depicts a sectional view of a portable signal unit.

RAPID DEPLOYMENT OPERATOR CONTROLLED PORTABLE EMERGENCY TRAFFIC CONTROL SYSTEM

BACKGROUND

This disclosure relates to transportable traffic control systems. This disclosure more specifically relates to transportable traffic control systems comprised of one or more signaling devices operated remotely by a single user. The apparatus allows a user to quickly establish control of approaching vehicular traffic from a safe location. This disclosure also relates to G08G1/0955.

Regardless of present safety guidelines, roadway traffic flagging is well known to be a somewhat dangerous task. Utilizing conventional signaling methods with traditional handheld traffic control devices creates a potentially unsafe situation wherein naggers are required to work in active roadways. In unanticipated and emergency situations where normal traffic flow is to be temporarily altered, promptly establishing control of approaching traffic is key to uphold the safety of both roadside workers and motorists. Traditionally, roadway hazards and emergency scenes requiring a temporary change in traffic flow, such as establishing two-way traffic in a single lane, task first responders with gaining control of approaching traffic while simultaneously handling the incident at hand. In many cases, upon arrival at a roadside incident, emergency responders are immediately tasked with mitigating traffic flow around said incident before proper traffic control devices can be placed in service. These situations all too often result in extreme bodily injury or death caused by traffic collisions. Based on this, decreasing, or eliminating the risk of emergency roadside workers being struck by approaching motorists would be a favorable outcome. The present invention aims to alleviate this risk by providing a portable, quickly deployed, wireless traffic signaling system controlled remotely by a single user from a relatively safe location. This system comprises a remote transmitter unit and one or more portable signal units wherein a user can quickly deploy said portable signal units and utilize the remote transmitter unit to activate traffic control signals to be displayed on the portable sign units in order to provide instruction to approaching traffic accordingly.

Previous attempts to create a mobile traffic control apparatus are limited in portability, ease of use, and overall time necessary to deploy said apparatus. Many portable traffic control systems require the use of a rolling platform, requiring transport in or towed behind a sufficiently large vehicle. Often the ability to transport the apparatus is limited to the size of the transporting vehicle and the physical capabilities of the user tasked with deploying the system. Unlike previous attempts, the present disclosure consists of flat collapsible sign units with incorporated carrying handles able to be transported in most small vehicles and hand-carried by a user without unnecessary carts or dollies.

Other previous attempts to create mobile traffic control apparatus also fail in providing sufficient adaptability in scenarios requiring rapid deployment. Often this apparatus requires electrical input from an external power source, the placement of a vehicle-sensing device, and the use of a designated detachable stand. Some attempts to create a mobile traffic control apparatus introduce a moderately complex series of tasks to deploy the system. Unlike previous attempts, the following discloses a series of portable signal units to be attached to a variety of surfaces when necessary, such as existing roadside traffic signs, traffic barriers, stationary vehicles, as well as a designated stand. The following also provides an extremely accessible method of deployment, wherein no external components are necessary for immediate operation and an internal means of power is incorporated into each portable sign unit.

SUMMARY OF THE INVENTION

The invention comprises a handheld remote-control unit and one or more portable traffic signal units. The purpose of the system is to provide a hand-carriable rapid deployment traffic control system for use by first responders, emergency personnel, and roadside services in order to quickly and effectively gain control of approaching traffic flow.

Each portable traffic signal unit incorporates two illuminated panels, wherein one panel instructs approaching motorists to stop and the other instructs approaching motorists to proceed. Each panel comprises a panel of LED lights behind a semitransparent signal panel with a frosted light diffusing filter, allowing approaching motorists to capably view the instructing signal without interference from external light sources. Whilst the unit is active, a smaller illuminated sign, integrated into one of the signal panels, warns approaching motorists with a preprinted phrase such as "Emergency Ahead" or "Caution".

The portable traffic signal units are intended to be placed at the roadside with the illuminated signal panels facing approaching traffic. Each unit is lightweight and compact to be hand-carried with ease and incorporate a folding collapsible design wherein a user can deploy each signal rapidly simply by releasing a safety latch, mounting the signal using a variety of mounting techniques, and powering the unit on. Each portable signal unit has an internal rechargeable power system without need for external means of power for extended durations of roadside use.

Each portable traffic signal unit illuminates the stop-signal until activated. The illuminated signal panels are activated by the handheld remote-control unit via wireless transceivers integrated in each portable traffic signal unit as well as the handheld remote-control unit. The handheld remote-control unit comprises a user control panel with activation triggers wherein each trigger activates an individual portable traffic signal unit. Upon activation, the specified portable traffic signal unit will illuminate the proceed signal and darken the stop-signal of the specified traffic signal unit until the unit is deactivated.

The signal control circuit integrated into both the remote-control unit and the traffic signal units incorporates a variety of safety features. If a portable traffic signal unit fails to receive a consistent signal from the remote-control unit transceiver, the traffic signal unit will automatically switch to a stop-signal until the signal becomes activated again. Only one portable traffic signal unit can be activated at one time. Each portable sign unit also comprises a system monitoring circuit to consistently report system status data to the remote-control unit via the integrated transceivers, which receives said system status data in order to verify that each portable traffic signal unit is operating properly. This includes serial data reporting of any fault in the internal battery system, a wireless signal failure, or miscellaneous potential circuit failures. The remote-control unit reports system errors to the user by illuminating warning lights on the remote-control unit control panel.

Upon deployment of one or more portable traffic signal units, a user can rapidly gain control of multiple directions of traffic while remaining in a safe location. This provides a safe means of mitigating traffic flow for single-lane roadways, multi-direction intersections, divided highways, lane closures, and other hazardous temporary traffic alterations.

DETAILED DESCRIPTION

Figure 1:
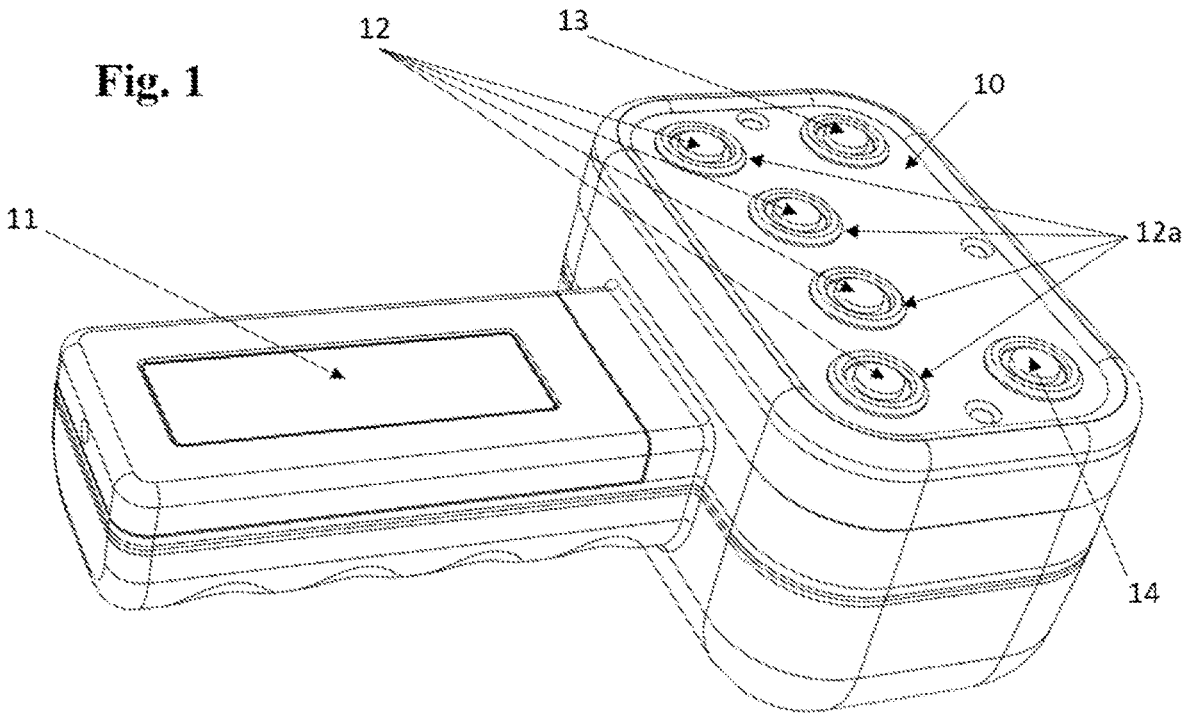
FIG. 1 depicts a front perspective view of the remote control unit.

Unless otherwise stated, all technical and scientific terms used herein have the same meaning as commonly understood by one of ordinary skill in the art to which the present invention belongs.

The present invention is intended to provide a means of quickly and effectively gaining temporary control of traffic in an emergency situation and to allow a user to manipulate the flow of approaching traffic from a nearby safe location. FIGS. 3-8 depict a single portable signal unit utilized to give instruction to approaching motorists. The invention is a system comprising a remote control unit and one or more portable signal units. Each portable signal unit is to be positioned at the roadside of approaching traffic using a variety of mounting surfaces utilizing the incorporated carry handle mounting bracket 5.

Upon being deployed, the portable signal unit has, a first static message panel 1, a second static message panel 2, and an advance warning signal 3 intended to face the direction of approaching traffic. Each of the aforementioned portable signal units comprise a backlight of recessed LED arrays 19B, 19C, and 19A such that the first LED array 19B illuminates a plurality of LEDs corresponding to the first static message panel, a second LED array 19C illuminates a plurality of LEDs corresponding to the second static message panel, and a third LED array 19A illuminates the flashing advance warning signal 3. A light diffusing panel 7 is layered behind the static message panels in front of the LED arrays 19B, 19C, and 19A such that the illumination from the LED arrays 19B, 19C, and 19A enables optimized visibility of the static message panels to approaching motorists.

Figure 2:
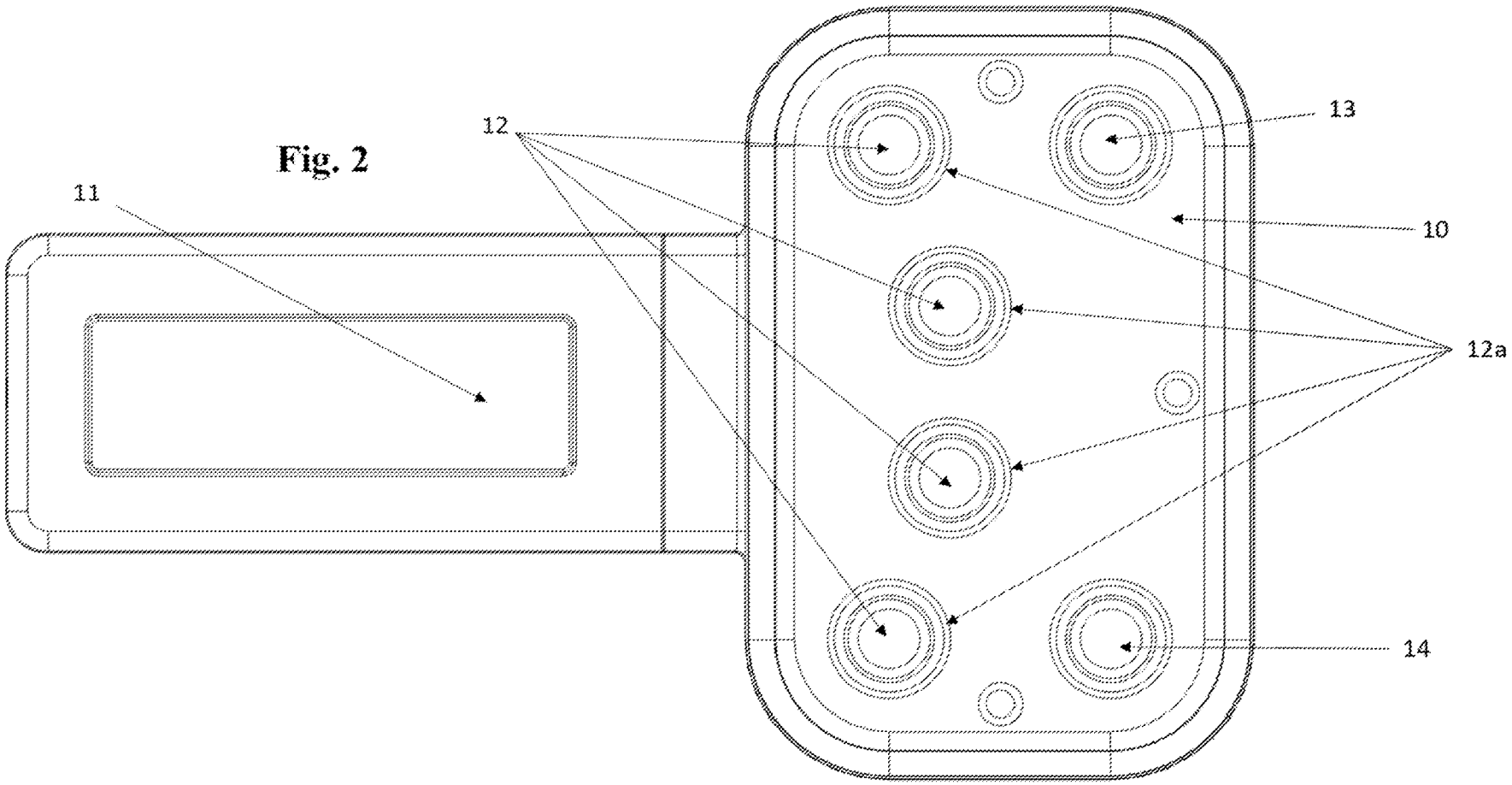
FIG. 2 depicts a top orthogonal view of the remote control unit.
Figure 3:
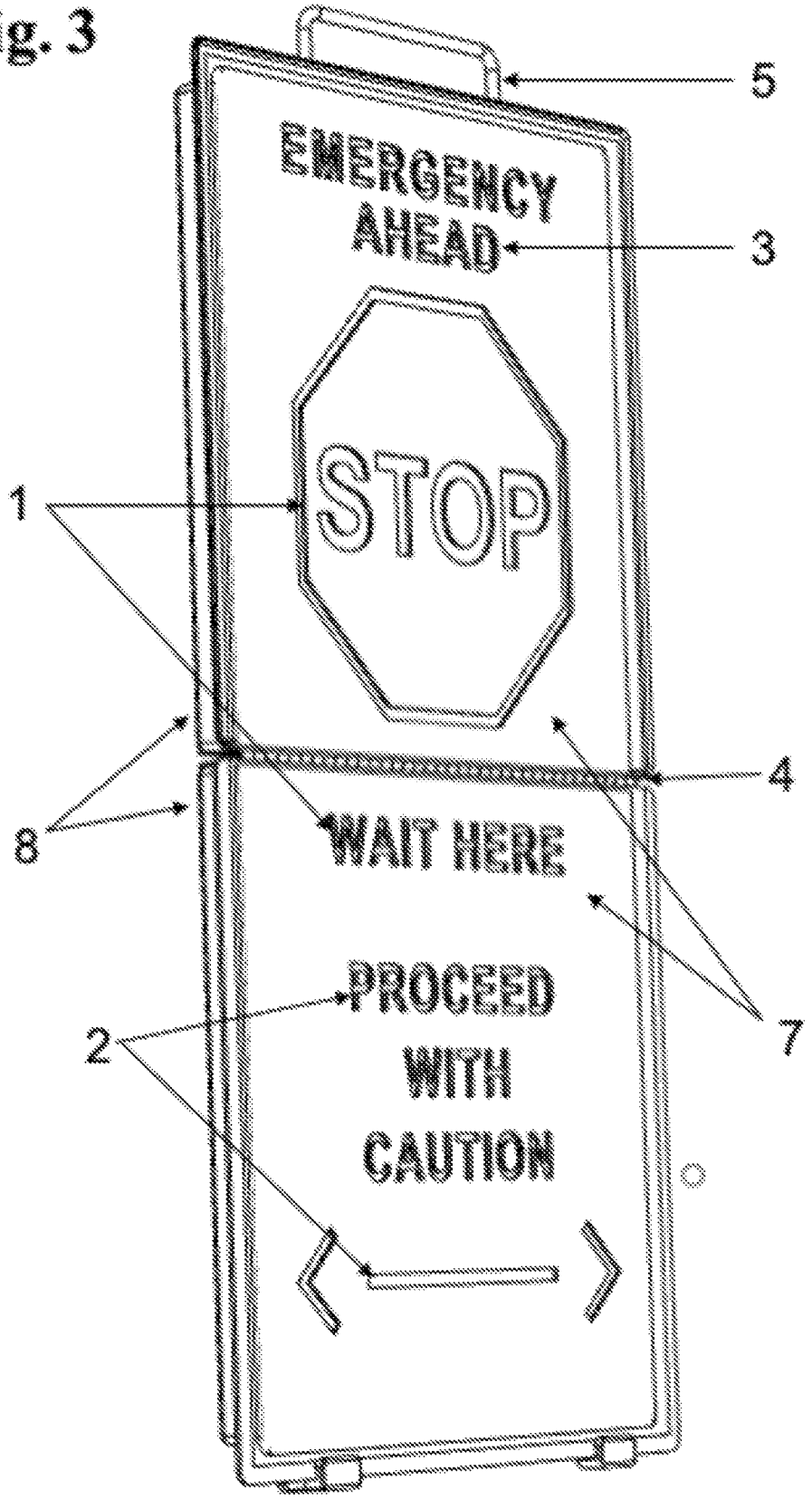
FIG. 3 depicts a front perspective view of a single portable signal unit in an open position.
Figure 4:
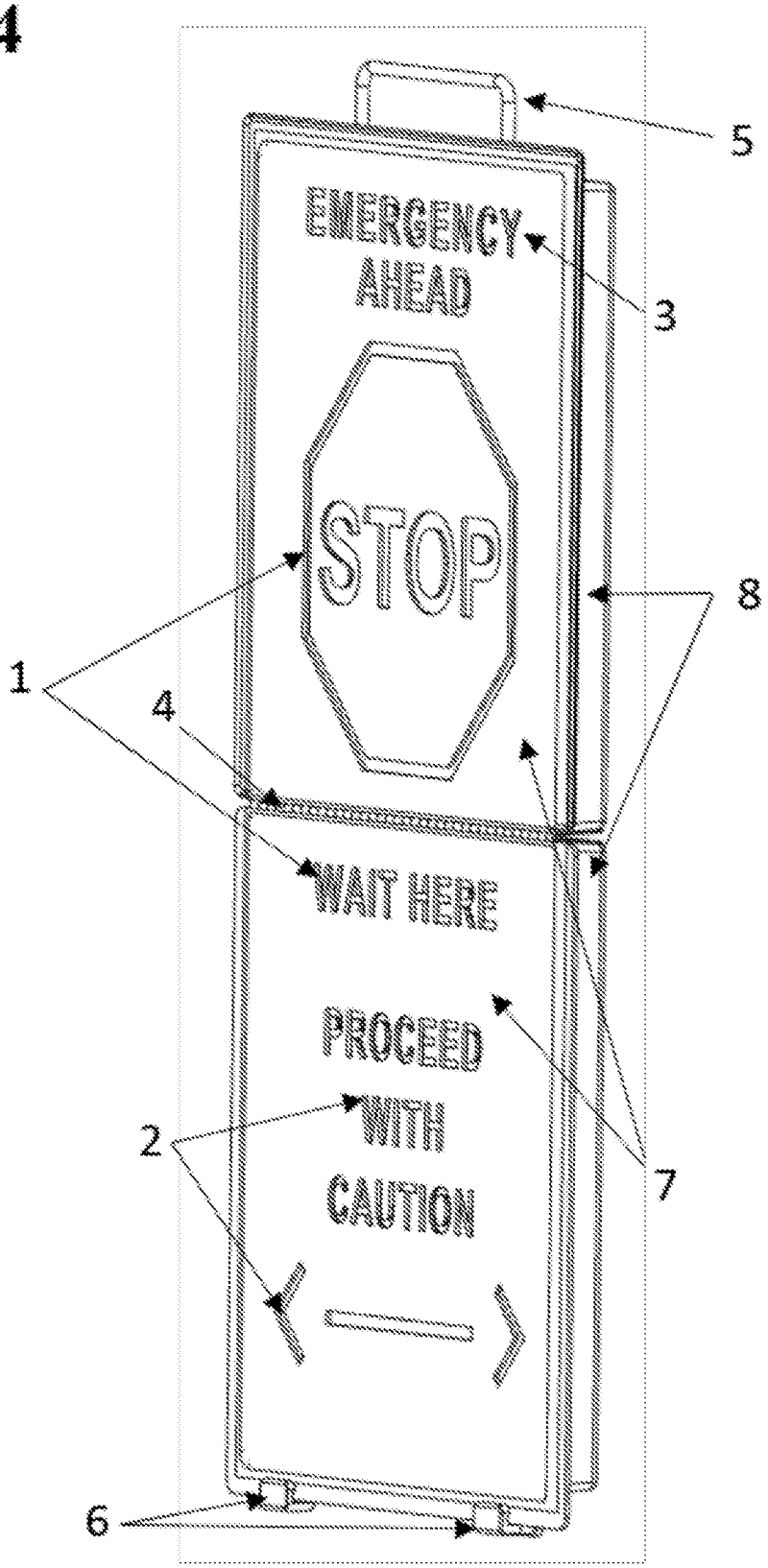
FIG. 4 depicts a right side perspective view of a single portable signal unit in an open position.
Figure 5:
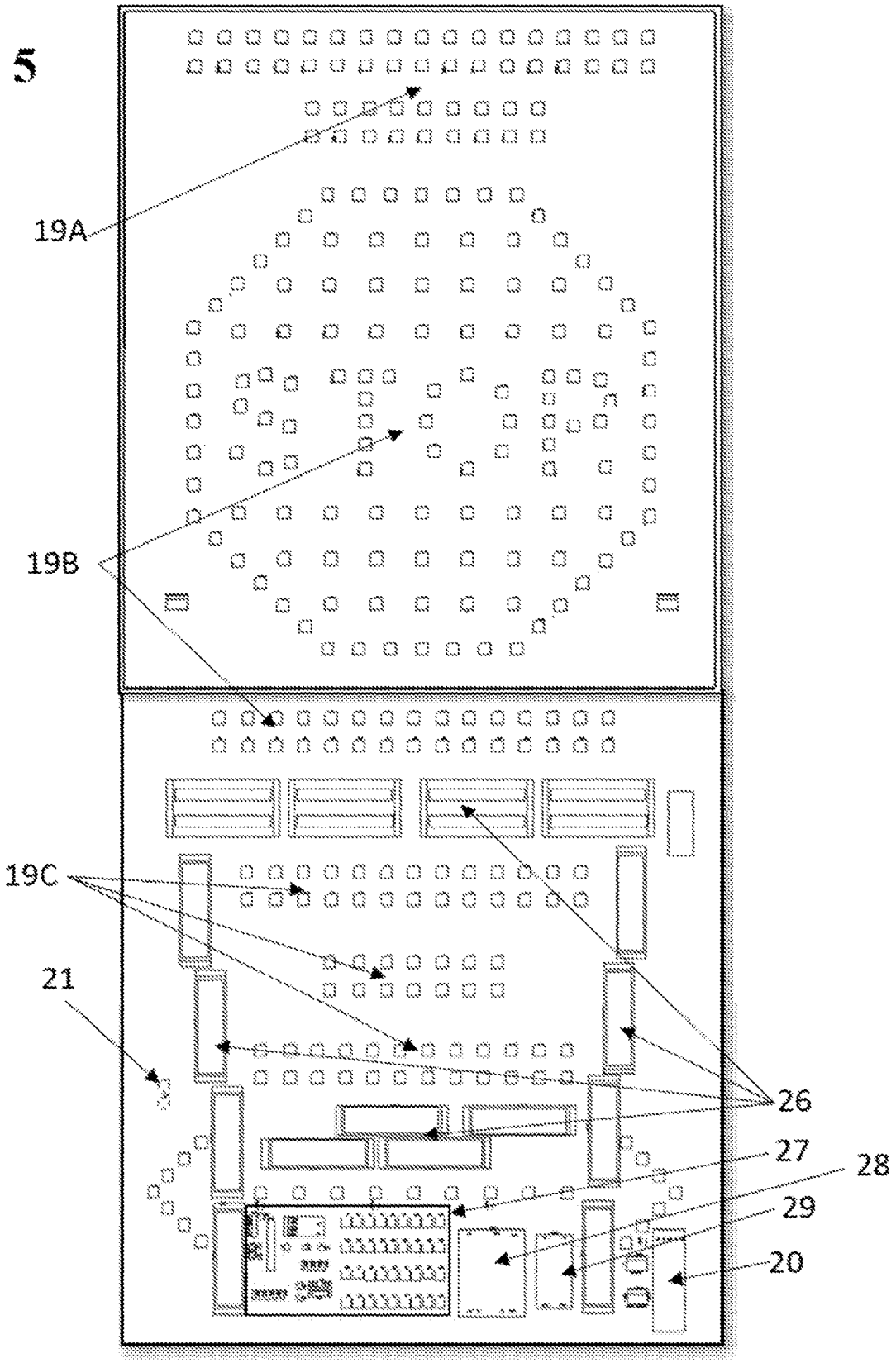
FIG. 5 depicts a front sectional view of a single portable signal unit in an open position.

Internally, the portable signal unit further comprises battery groups 26, a battery charging and monitoring circuit 20, an LED driver circuit 27, a signal control circuit 28, a transceiver 29, and an antenna 21. Upon activation, the signal control circuit 28 illuminates a predetermined segment of the static message panels and advance warning signal 3 simultaneously by the LED driver circuit 27 based on default programming. Upon deploying the signal units, a user utilizes the remote control unit, depicted in FIGS. 1-2, to operate the system. The remote control unit therein comprises an internal battery 11 and an internal transceiver control circuit 10, further comprising a series of activation switches 12, a series of activation-indicating LED lights 12A, a master deactivation switch 14, and a power switch 13.

The series of activation switches 12 correspond to each of the portable signal units facing in the direction of approaching traffic such that each switch activates a predetermined segment of the static message panels corresponding to a traffic instruction. Upon activating a signal unit, the internal transceiver control circuit 10 transmits an activation signal detected by the antenna 21 and transceiver 29 inside the pre-selected portable signal unit. In a preferred embodiment, upon receipt of an activation signal, the signal control circuit 27 illuminates the backlight of the first static message panel 1, and darkens the backlight of the second static message panel 2. This action allows a user to remotely alter the instruction provided to an approaching motorist at a selected portable signal unit. Upon successful signal activation, the signal control circuit 27 transmits serial confirmation data via the transceiver 29 to be received by the remote control unit's internal transceiver control circuit 10, which illuminates the respective activation-indicating LED light 12A. Upon deactivation of the selected signal unit, the internal transceiver control circuit 10 will cease signal transmission, thereby causing the signal control circuit 27 to return to the default predetermined setting.

The master deactivation switch 14 allows the remote control unit's internal transceiver control circuit 10 to transmit a predetermined wireless transmission to the portable signal unit's transceiver 29 that deactivates the LED driver circuit 27 in order to deactivate all portable signal units and their internal LED arrays until the master deactivation switch 14 is deactivated.

The battery charging and monitoring circuit 20 incorporated into the portable signal unit enables safe charging of the internal battery groups 26 and provides consistent monitoring of pertinent electrical data. If an electrical fault or electronics failure is detected in a portable signal unit, the signal control circuit 27 transmits data via the transceiver 29 to be received by the remote control units internal transceiver control circuit 10, which then activates a preprogrammed alert pattern on the associated indicating LED light 12A.

In an event wherein a user attempts to activate multiple activation switches 12 at one time, the remote control unit's internal transceiver control circuit 10 will restrict transmission of the signal until all portable signal units are no longer activated.

Figure 6:
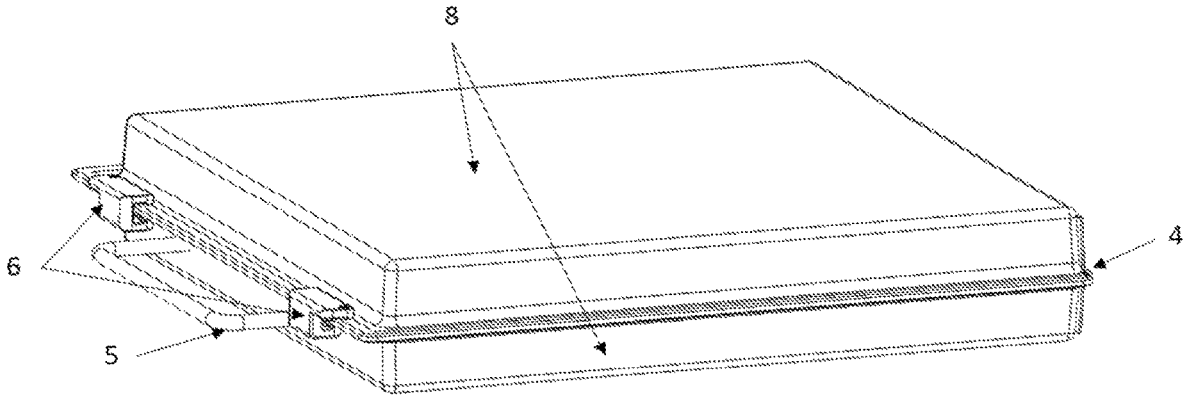
FIG. 6 depicts an isometric view of a single portable signal unit in a closed position.
Figure 7:
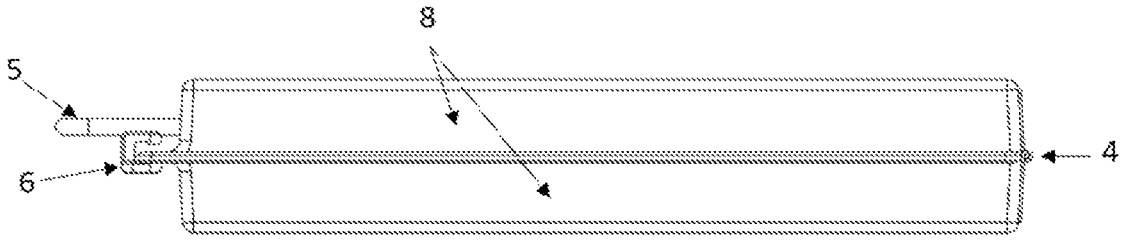
FIG. 7 depicts a side orthogonal view of a single portable signal unit in a closed position.
Figure 8:
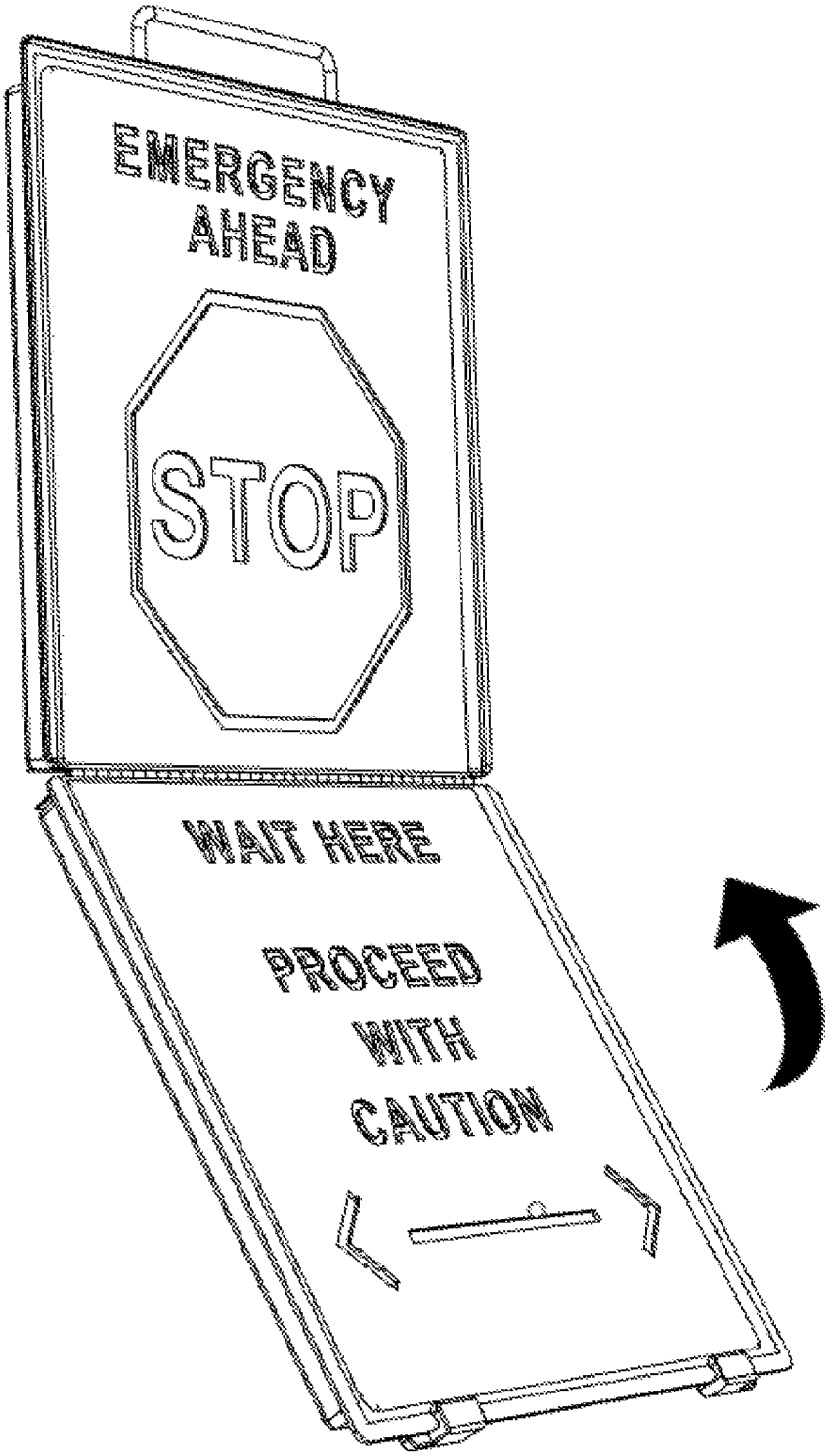
FIG. 8 depicts a perspective view of a single portable signal unit transitioning to a closed position.
Figure 9:
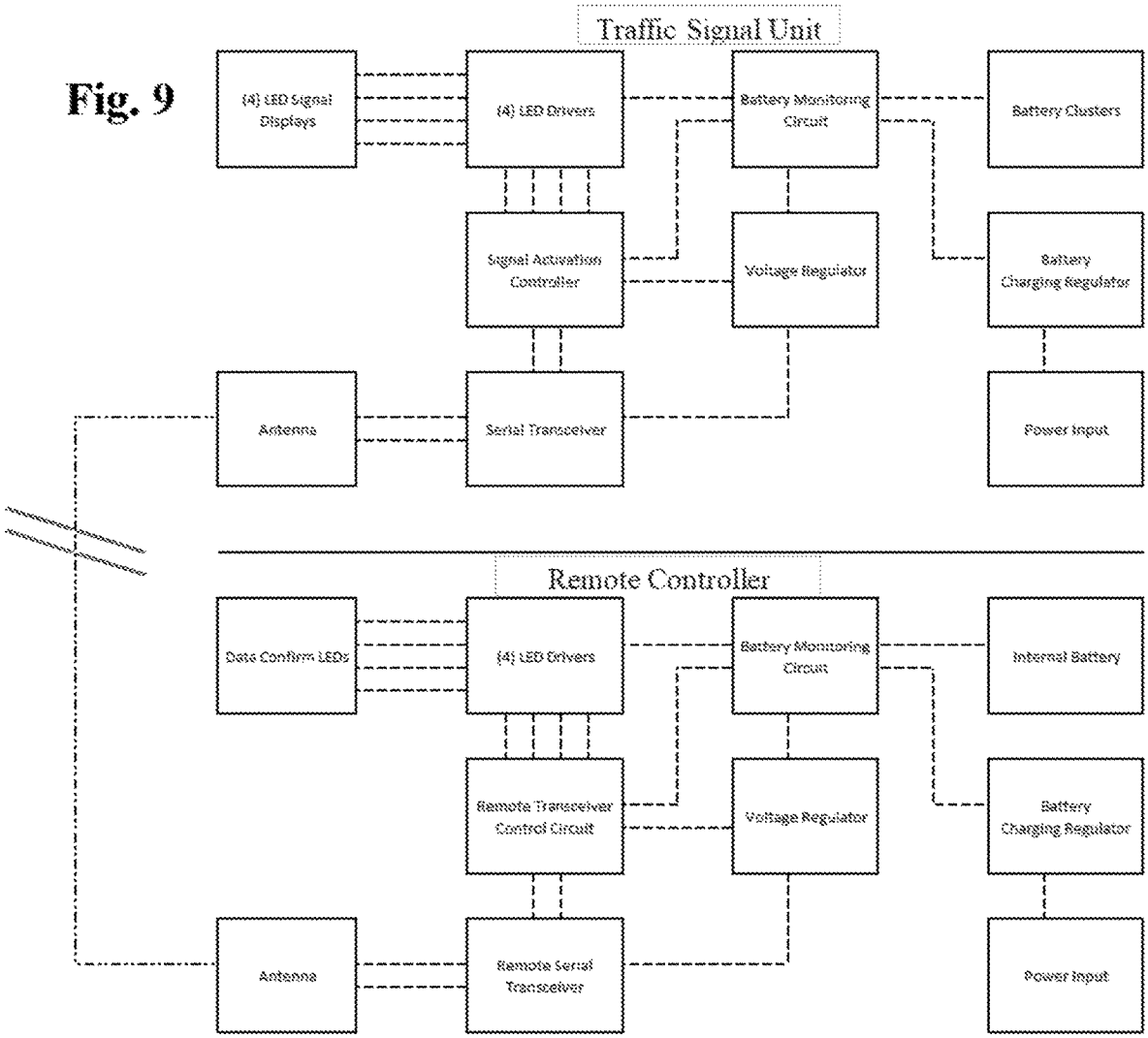
FIG. 9 depicts a circuit diagram of the remote control unit and portable signal unit.
Figure 10:
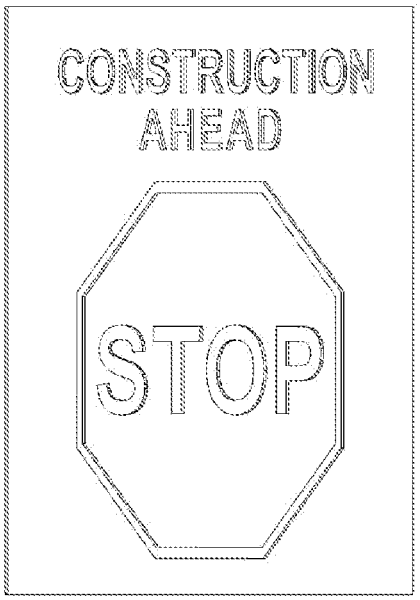
FIG. 10 depicts a front perspective view of a static message panel.
Figure 11:
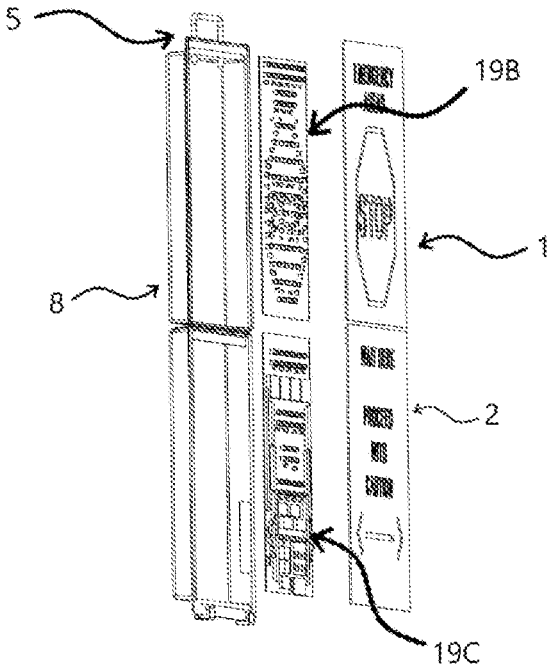
FIG. 11 depicts a sectional view of a portable signal unit.

Upon cessation of use, the portable signal unit can be collapsed to a closed position as depicted in FIGS. 6-7. The outer components of the portable signal unit comprise a hinge mechanism 4, a series of latches 6, and a rigid outer case 8. The portable signal unit can be collapsed to a closed position by utilizing the hinge mechanism 4 such that both static message panels are brought together in a folding motion depicted in FIG. 8. The series of latches 6 then fix the panels in this position. The rigid outer case 8 used to support the sign while in a deployed position becomes a means of protection during transport in this closed position.

The invention claimed is:

1. A user-controlled portable traffic control system comprising: a wireless remote-control unit comprising:
a user-controlled interface;

a first transceiver; and a plurality of status indicator lights, each corresponding to a portable signal unit; and one or more portable signal units, each comprising:

a two-part collapsible rigid outer case;

a second transceiver;

a signal control circuit;

an internal battery;

a means of circuit monitoring; and a segmented backlit display side, comprising:

a first and a second message panel, each being disposed in front of a backlight and each having a light diffusing layer incorporated with a static message panel; and an illuminated flashing advance warning signal.

2. The user-controlled portable traffic control system as claimed in claim 1, wherein the first and second transceiver communicates commands from the user-controlled interface to the signal control circuit and the second transceiver communicates serial data, displayed by the status indicator lights; from the means of circuit monitoring to the user-controlled interface.

3. The user-controlled portable traffic control system as claimed in claim 1, wherein the signal control circuit activates a predetermined default function of the backlit display corresponding to the first or the second message panel, and the illuminated flashing advance warning signal simultaneously.

4. The user-controlled portable traffic control system as claimed in claim 2, wherein the signal control circuit alters the output of the segmented backlit display by illuminating segments corresponding to signals received by the second transceiver from the first transceiver.

5. The user-controlled portable traffic control system as claimed in claim 1, wherein the two-part collapsible rigid outer case further comprises a versatile mounting handle having a means for carrying as well as suspending the portable signal units from a static structure.

* * * * *